US005197405A

United States Patent [19]

King

[11] Patent Number: 5,197,405

[45] Date of Patent: Mar. 30, 1993

[54] AUXILIARY BOAT WHEEL APPARATUS

[75] Inventor: William C. King, Mercersburg, Pa.

[73] Assignee: Tuscarora Designs, Inc., Mercersburg, Pa.

[21] Appl. No.: 814,412

[22] Filed: Dec. 23, 1991

[51] Int. Cl.[5] ..... B63B 21/64

[52] U.S. Cl. ..... 114/344; 188/174; 188/177; 188/185

[58] Field of Search ..... 114/344; 380/414.2, 380/414.1; 188/174, 177, 185

[56] References Cited

U.S. PATENT DOCUMENTS

| | | | |
|---|---|---|---|
| 347,872 | 8/1886 | Ferguson | 188/177 |
| 845,633 | 2/1907 | Hallot | 188/185 |
| 2,042,598 | 6/1936 | Harvey | 115/1 |
| 2,622,893 | 12/1952 | Wasserlein | 280/61 |
| 2,929,079 | 3/1960 | Totten | 9/1 |
| 2,999,252 | 9/1961 | Norrby | 9/1 |
| 3,113,686 | 12/1963 | Sundin | 214/84 |
| 3,154,799 | 11/1964 | Jalowiecki | 9/1 |
| 3,185,330 | 5/1965 | Buckner | 214/506 |
| 3,195,919 | 7/1965 | Lossman | 114/344 X |
| 3,210,784 | 10/1965 | Krance | 9/1 |
| 3,284,821 | 11/1966 | Zoretic | 9 R/1 |
| 3,295,864 | 1/1967 | Norrby | 280/414 |
| 3,453,002 | 7/1969 | Wild | 280/63 |
| 3,499,177 | 3/1970 | Wolfe | 9/1 |
| 3,733,628 | 5/1973 | Helbig | 280/414 |
| 3,779,573 | 12/1973 | Gullberg et al. | 280/34 |
| 3,982,292 | 9/1976 | Johnson . | |
| 3,986,723 | 10/1976 | Brockelsby | 280/47.13 B |
| 4,300,252 | 11/1981 | Montooth | 280/414.2 |
| 4,344,635 | 8/1982 | Welton | 280/414 |
| 4,422,665 | 12/1983 | Hinnant | 280/414 |
| 4,515,102 | 5/1985 | Kury | 114/344 |
| 4,567,844 | 2/1986 | Johnson | 114/344 |
| 4,629,036 | 12/1986 | Choy | 188/177 X |

*Primary Examiner*—Sherman Basinger

*Attorney, Agent, or Firm*—Eckert Seamans Cherin & Mellott

[57] ABSTRACT

A transportation and launching device for boats which can be handled by one person and which is carried with the boat during overland transportation, launching, and water operation of the boat. The device remains completely external to the boat during operation and storage and may be equipped for manual or automatic adjustment of the wheel axles to the longitudinal center of gravity of the boat to accommodate loading changes affecting the center of gravity. The device is typically used with the boat in an upright position but may be adjusted to move the boat in an inverted position as an aid in maintenance. The device is removable for compact storage and may be adjusted to fit on boats of various sizes.

21 Claims, 12 Drawing Sheets

AUXILIARY BOAT WHEEL APPARATUS

BACKGROUND OF THE INVENTION

1. Field of the Invention

The present invention relates to field of retractable wheel systems for launching and recovery of boats in water, and for transportation of boats overland. The wheels may be adjusted to positions suitable for land transportation and for water travel, and are coupled by a transverse member such that the wheels are deployed or stowed as a single unit.

2. Description of the Prior Art

The prior art includes a number of examples of boat-attached wheel systems which are manufactured for long distance transportation, but which are unsuitable for intermittent convenience transport of the boat because of their complicated mechanical structure and their concomitant cost. Examples include Kury (U.S. Pat. No. 4,515,102), Buckner (U.S. Pat. No. 3,185,330), Sundin (U.S. Pat. No. 3,113,686), H:son Gullberg et al. (U.S. Pat. No. 3,779,573), Helbig (U.S. Pat. No. 3,733,628) and Wasserlein (U.S. Pat. No. 2,622,893).

Boat attached wheel systems are also known which require that the boat be inverted to be wheeled about, because the wheels protrude upwardly. This type of device is unsuitable for moving a loaded boat, and for launching and recovering the boat, because a boat cannot be loaded or floated until positioned upright. Such systems include Wolfe (U.S. Pat. No. 3,499,177).

Boat attached wheel systems are further known which teach separate and independently-operated left and right wheel assemblies. Where the wheels are deployed or stowed one at a time, the boat and its operator are "off balance" when only one of the wheels is deployed. This "off balance" position can be dangerous in small boats which are easily capsized. Examples of these systems include Brockelsby (U.S. Pat. No. 3,986,723), Zoretic (U.S. Pat. No. 3,284,821), Totten (U.S. Pat. No. 2,929,079), Wolfe (U.S. Pat. No. 3,499,177), Kury (U.S. Pat. No. 4,515,102) and Johnson (U.S. Pat. No. 3,982,292).

Retractable wheel systems for launching boats as known in the prior art typically are such that the wet wheels are moved into the people-occupied area of the boat when stowed, where they take up scarce space and may get the contents and/or occupants of the boat wet. In the alternative, some retractable wheel systems in the prior art bring the wheels up along the lateral sides of the boat, thus occupying the limited side access and/or viewing space along the sides. It would be more appropriate if possible to reserve the side space for passenger use as needed for fishing, rowing or the like. Examples of retractable wheel systems with these shortcomings include Brockelsby (U.S. Pat. No. 3,986,723), Kury (U.S. Pat. No. 4,515,102), Johnson (U.S. Pat. No. 4,567,844), Norrby (U.S. Pat. Nos. 2,999,252 and 3,295,864), Jalowiecki (U.S. Pat. No. 3,154,799) and Harvey (U.S. Pat. No. 2,042,598).

The prior art typically provides a wheel axle arrangement with a single deployed or operating position along the longitudinal axis of the boat. However, when a boat is loaded and unloaded from an end, its overall center of gravity moves forward or backward along its length. While supporting the boat on its wheels the operator must bear a portion of the weight of the boat and contents which is proportional to the distance between the boat's center of gravity and the operational axle position. Hinnant (U.S. Pat. No. 4,422,665) teaches a means to move a boat wherein it is possible to vary the wheel position; however, this is because there is no fixed assembly of relocatable wheels attached to the boat. The boat is moved onto the device which is then strapped into place. The boat is launched from the device and recovered onto the device. The wheel bearing device itself does not remain with the boat while the boat is being operated, but instead is left on shore. Once strapped in place, no provision is made for relocating the wheels to accommodate changes to the center of gravity due to loading or unloading.

Detachable wheel mountings as in Hinnant are subject to the possibility that the mountings will fall off the boat during the launching and recovery phase of the operation. It is conceivable that the mountings could be lost entirely in the water. A further example is shown in Wild (U.S. Pat. No. 3,453,002).

SUMMARY OF THE INVENTION

It is an object of the invention to address the above shortcomings in the prior art to produce a convenient, efficient and durable boat wheel device which is attached permanently to the boat and can be deployed, stowed and relocated along the axis of the boat, with a minimum of disruption to the occupants. The invention is inexpensive to manufacture and easy to install and operate. It allows upright transportation of a loaded boat overland for short distances and for launching and recovery of the boat by a single operator. It may also be adapted for transportation of the boat in an inverted position, at variable heights, as is convenient for hull maintenance, etc. The device remains with the boat during operation, stored out of the way behind the boat transom. The specific structure provides simultaneous and counterbalanced retraction of the wheels, keeping the operator safely balanced during operation. Whereas the invention provides for a variable axle position, the wheels may be repositioned longitudinally to obtain a desired relationship with the boat's center of gravity, thus minimizing the operator borne weight of the boat.

It is a further object of the invention to provide for automatic axle positioning to ease the operator's task in moving, launching and recovering the boat. Automatic positioning is accomplished by converting additional downward force produced by an increased load to a force which moves the wheel axle position longitudinally toward the load. This mechanism operates against a spring, and returns the wheels toward their original position when the load is thereafter reduced.

It is also an object of the invention to provide an automatic braking mechanism which slows the boat's movement in the event that the operator loses control. The automatic braking mechanism can be actuated by excessive wheel speed, tilting, and/or jarring of the boat.

It is yet another object of this invention to provide useful storage, safety, and/or operationally functional attachments for the boat operator's use. Thus the invention not only provides for easy overland transport, launch, and recovery, but also can include such features as additional fuel storage, beverage holders, safety flotation devices, flare holders, fishing pole holders, adjustable oar pivots, etc., which render the invention useful while the boat is in operation on the water.

These and other objects are accomplished by an auxiliary deployable boat wheel apparatus for all terrain transportation, launching, and recovery of a boat, the boat having front and rear longitudinal end portions, first and second lateral sides, and a bottom. The apparatus comprises a first upright member and a second upright member for the respective lateral sides of the boat. Each has a pivot point defined by a mounting means, with the two pivot points being coaxial and defining a pivot axis along a lateral line through the boat. Each pivot point separates the respective upright members into an upper portion and a lower portion, the lower portion having a distal end for carrying a wheel. The mounting means is adjustable whereby the first and second upright members can be set at least to one of a substantially vertical position and a substantially horizontal position. Means are provided for securing the first and second upright members in at least one of the substantially vertical position and the substantially horizontal position. Each of the upright members carries a wheel, rotatably mounted to the distal end of the lower portion.

A horizontal connecting member is rigidly attached between the lower portions of the first and second upright members. A first longitudinal adjusting means and a second longitudinal adjusting means are rigidly secured to the boat above its water-line and extend in a forward and a rearward direction along a span preferably encompassing the longitudinal center of gravity of the boat on the lateral sides. The longitudinal adjusting means adjustably secures the mounting means along a substantial part of its length. Thus the first and second upright members are adjustable, for example to keep the wheels in an operating position (e.g., at the center of gravity) when in the vertical position, and can place the wheels in a storage position above the water-line at the rear end of the boat.

The upright members are movable approximately 180° about the pivot point from an upright operating position to an inverted operating position. In the upright operating position the wheels are at least partly below the bottom of the boat, and in the inverted operating position the wheels are at least partly above a top edge of the boat. Therefore the boat may be transported over the ground and launched in an upright attitude with the upright members in the upright operating position, or in a bottom-up attitude, with the upright members in the inverted operating position.

The wheel structure is completely external to the boat in both the operating position and the storage position and thus does not occupy passenger or load space.

The horizontal connecting member can include a length adjusting means to accommodate a variety of boat widths and may be collapsed for more compact storage when separated from the boat.

A height adjusting means allows the pivot point to be moved along a span of the upright member, whereby the height of the boat in the upright or inverted operating positions can be set by an operator. An automatic adjustment means can be provided for keeping the wheels under the center of gravity while operating. The automatic adjustment means can include at least one torsionally sprung joint located in the lower portion of the upright members.

The wheels on each opposite side can be individual or can be at least one pair of ganged dual wheels, to provide a more stable platform around said center of gravity.

The automatic adjustment means may include at least one resiliently deformable member and at least one mechanical means operable to convert downward force (or changes therein) caused by the weight of the load into a force tending to move the wheels toward the center of gravity. The resiliently deformable member acts to restore the wheels to a position beneath the new center of gravity when the load is removed.

The wheel mounting structure is adapted to be adjusted between the operating position and the storage position by hand, without tools, and is also adapted to allow removal and installation by hand.

A self actuating brake means can be provided which is actuated by excessive speed and/or a boat orientation (e.g., tilting).

The upper portions of the upright members can include functional recesses. The recesses can function as a beverage container holder while the wheel structure is operating and/or being stored. Similarly, the recesses can function as fishing pole holders, oar pivot receptacles, or flare holders. The recesses can be functional while the wheel structure is either operating or in storage. While the boat operates on the water, the operator also has the option to adjust the oar pivots arranged along the side rails to a more comfortable position than a standard oar pivot receptacle allows.

The upper portions of the upright members can include a counterweight. With the counterweight, moving the wheel structure from the operating position to the storage position requires only a minimum of effort. The counterweight can include a fluid storage reservoir which an operator can use for auxiliary fuel, water, etc.

The wheels on each opposite side can be highly buoyant, to provide additional boat stability in rough water (in the manner of pontoons and/or outriggers). The highly buoyant wheel structure provides stability while in the storage position and minimizes drift when deployed while on the water. A quick release means for the highly buoyant wheels provides an additional measure of safety. When released, the highly buoyant wheels can function as a life preserver in an emergency.

Other objects and advantages of the invention will become apparent from the following description and the accompanying drawings, which are directed to exemplary embodiments.

BRIEF DESCRIPTION OF THE DRAWINGS

The drawings show embodiments of the invention that are presently preferred. It should be understood that the invention is not limited to the arrangements and instrumentalities shown in the drawings and is capable of embodiments in other groupings of parts, subassemblies and the like, in accordance with the scope of the invention claimed.

DETAILED DESCRIPTION OF THE INVENTION

Figure 1:
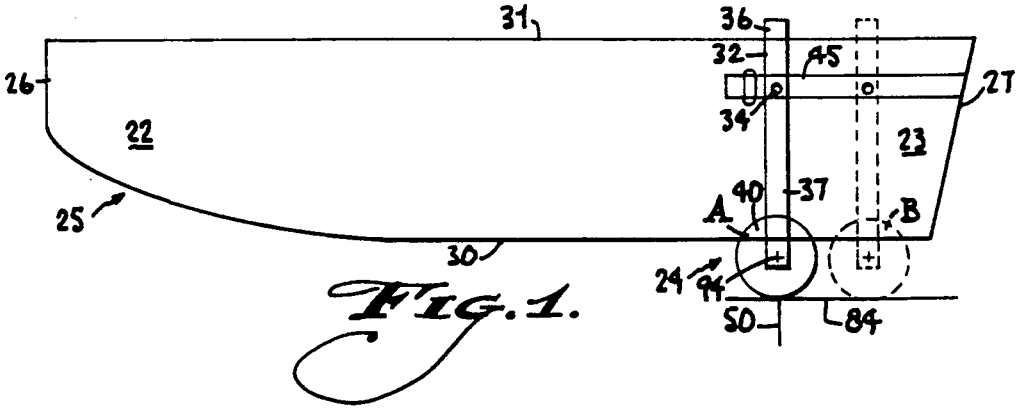
FIG. 1 is a side elevation view of the invention showing overland transportation of a boat with the wheel mounting apparatus in an operating position.

Referring to FIG. 1, an auxiliary deployable boat wheel apparatus 24 according to the invention is primarily used to facilitate all terrain transport of a fully loaded small boat 25. A loaded boat of course must be upright for transport. The invention also contemplates inverted transport. A single person (not shown) can move the boat without the need of a trailer although a trailer or the like can still be utilized if desired. For example, a vehicle could haul the boat close to a water access area. The invention is particularly appropriate in areas where it is not possible for vehicle/trailer to navigate.

The boat may be loaded, for example, by the weight of its motor, fuel, battery, fishing tackle, clothes, food, beverages, etc. The aft section 23 of the boat 25 is normally loaded prior to or instead of the fore compartment 22 because the aft section 23 typically has more space. Additionally, portions of the load 62 such as the motor, batteries and fuel are required aft for functional reasons. Other provisions such as lights, flares, life vests, tools, anchors, etc. add to the weight. By design, virtually all boats are not symmetric from front to rear. Most boats include a heavier construction of the transom 27, as required to carry the motor and a narrow front end 26 or "nose," as required for stable tracking and planing. The longitudinal center of gravity 50 of an unloaded boat 25 therefore typically lies $\frac{5}{8}$ (position A) to $\frac{3}{4}$ (position B—shown in broken lines) of the way toward the rear transom 27.

The invention uses leverage in conjunction with a wheel axle 94, positionable below the longitudinal center of gravity 50 to balance boat 25 relative to the axle position 94. This positioning can be achieved regardless of variations in load 62. Provided the axle 94 is centered precisely beneath the center of gravity 50, the operator has only to overcome inertia and rolling resistance to move the boat 25. The operator need not lift any weight; however, if desired the operator has the option of setting the axle position slightly off the center of gravity, to provide a weight bias. Two of the many variable axle positions 94 are shown in FIG. 1 as positions A and B.

Figure 2:
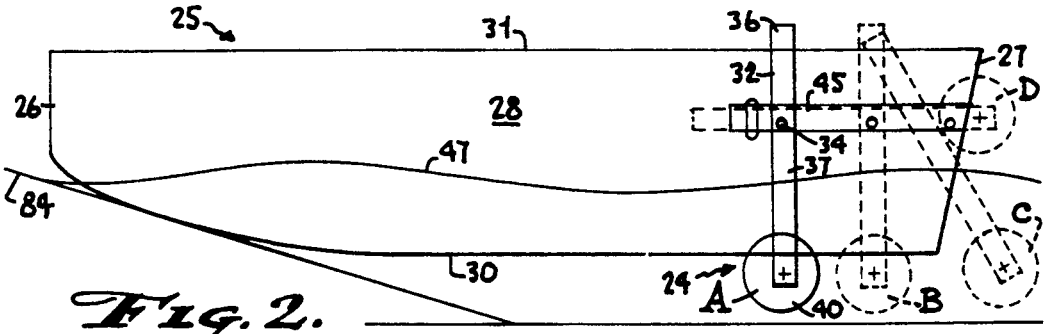
FIG. 2 is a side elevation view of the invention as installed on a boat in the launch/recovery stage of operation.
Figure 3:
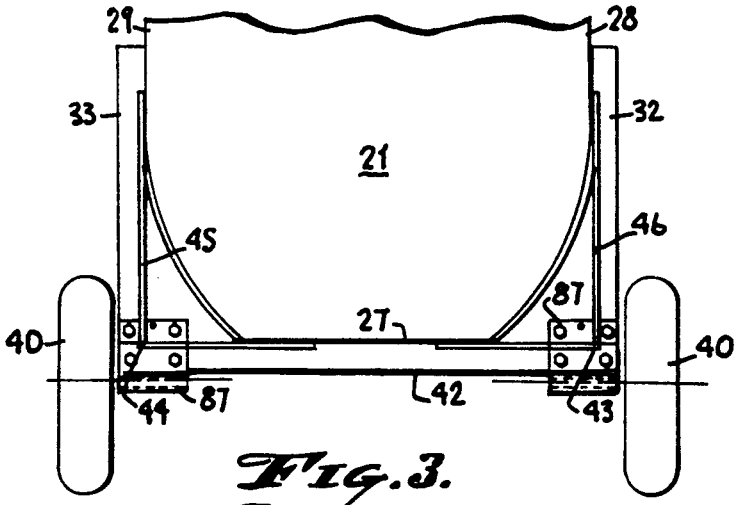
FIG. 3 is a top plan view illustrating the storage position.

The wheel structure 24 allows a fully loaded boat to be moved using only human power. Thus at the start of a boating trip the wheel structure 24 is lowered into substantially vertical, operating position (pos. A). A single person can nose a fully loaded boat 25 into a pickup truck or station wagon. Once the boat 25 is secured, the invention 24 is retracted and locked into its transit, substantially horizontal, storage position (pos. D—shown in broken lines). At the destination, the loading process is reversed and the boat is rolled to the launch area. The launching process keeps the operator's feet (not shown) dry by submerging the wheels 40 first. The operator steps into the boat 25 with the nose 26 still on land 84. The operator pushes off once the boat 25 has reached a position as indicated in FIG. 2 (in which the boat 25 is pictured just prior to launch). The operator, without tools and from a seated position, can simply release two knobs (FIG. 13) to stow the wheel mounts, one of the knobs being located on each of the left side and right side uprights 32, 33, as seen in FIG. 3). The operator then slides the assembly 24 rearward from position A or B, rotated through position C to storage position D out of the way and out of the water. The operator locks the invention in the storage position with the same knobs.

The uprights 32, 33 each include a pivot point 34. The pivot points 34 allow the operator to employ mechanical advantage to substantially reduce the effort required to operate the wheel structure 24. Thus, the operator performs the wheel lowering or retraction process from a perfectly balanced seated position in the center of the boat 25. The operator need not lean to one side and thus risk overturning or swamping the boat.

Figure 6:
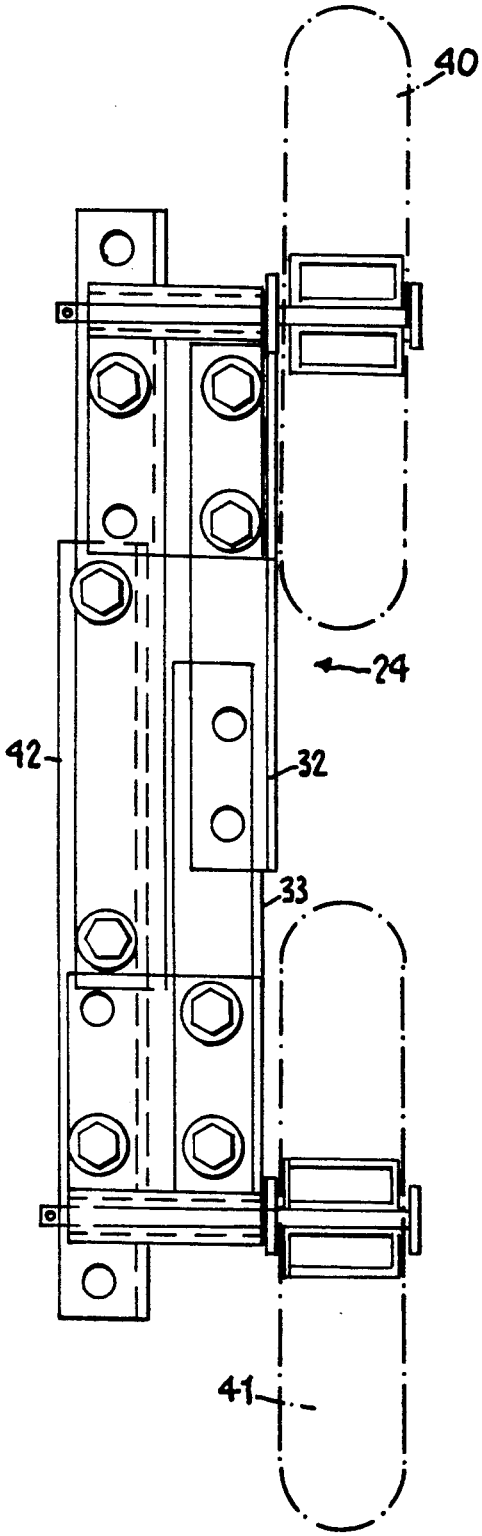
FIG. 6 is a top plan view of the wheel mounting apparatus folded for storage when detached from the boat, the wheels being shown in cross section for clarity.

The invention 24 is continuously attached to the boat throughout the period of transport, launching, recovery and water operations to prevent loss. The invention never intrudes into the occupant and load area 21 of the boat 25. For long term storage, however, the assembly can be readily and rapidly removed and folded flat with the uprights nested together as seen in FIG. 6; the wheel structure 24 is folded into a compact package that can be conveniently stored.

Figure 7:
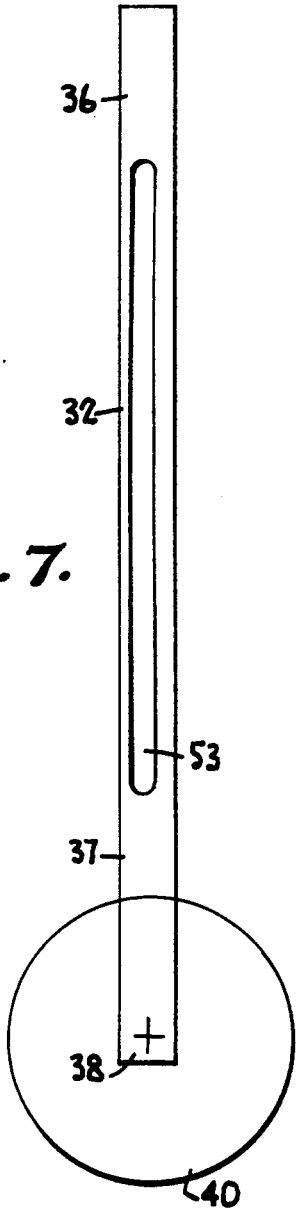
FIG. 7 is a side elevation view showing an upright member.
Figure 8:
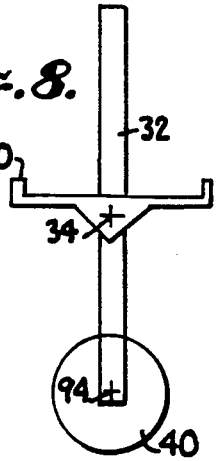
FIG. 8 is a side elevation view of an upright member with a cradle attached.
Figure 9:
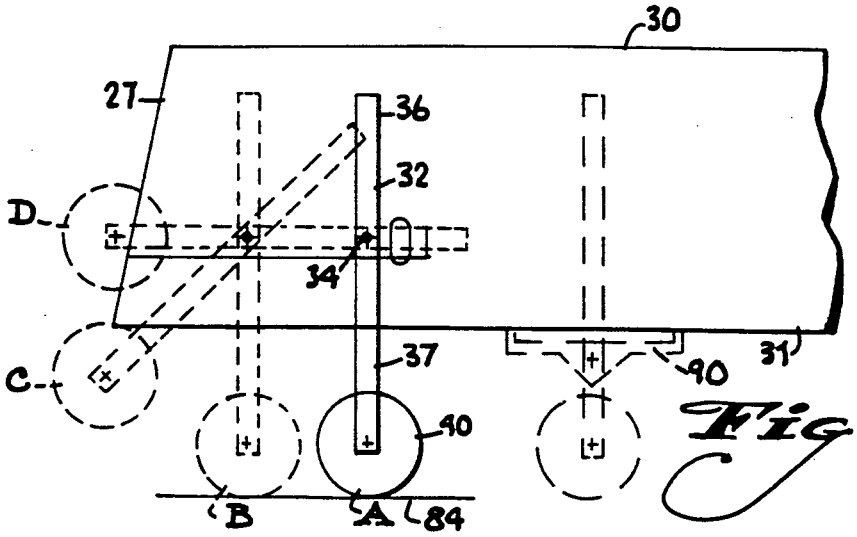
FIG. 9 is side elevation view of the invention showing use with the boat inverted.
Figure 10:
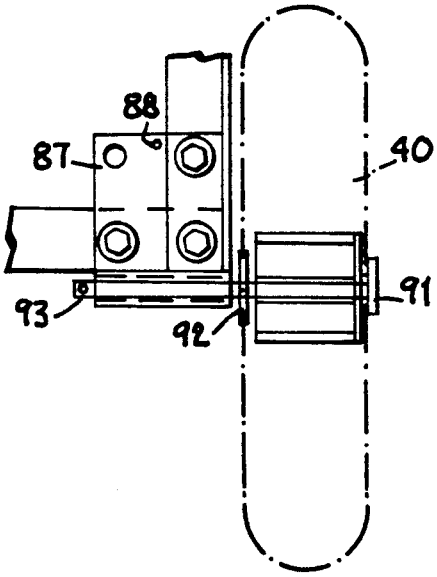
FIG. 10 is a front elevation view of the wheel mounting bracket as installed, with the wheel shown in cross section.
Figure 12:
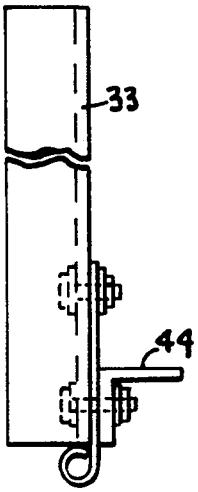
FIG. 12 is a side elevation view corresponding to FIG. 11.
Figure 11:
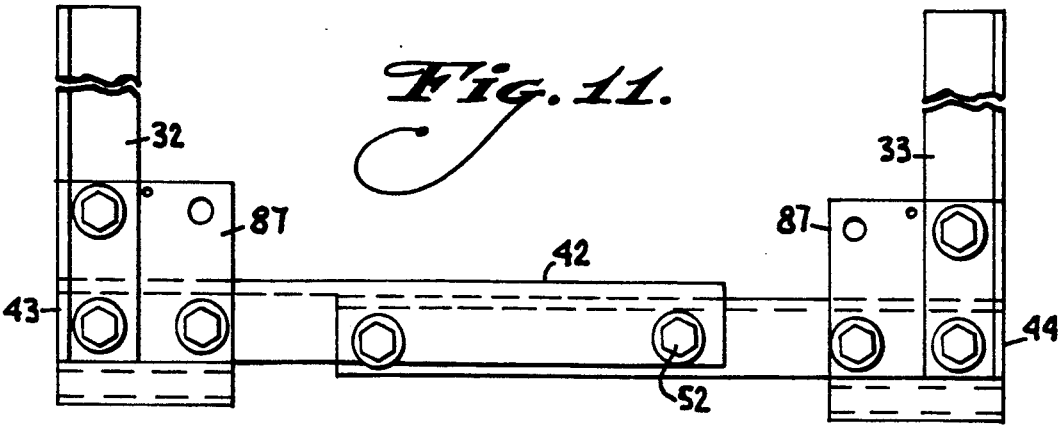
FIG. 11 is a front elevation view of the connection between the upright members and the horizontal connecting member.

The invention facilitates boat maintenance with respect to the hull bottom 30 or the top side 31. It allows easy maneuvering and keeps the boat elevated at a convenient work height using upright elements 32, 33. The upright elements can include a height adjusting slot 53 as seen in FIG. 7, whereby the work height is easily adjustable. For bottom side 30 maintenance, wheel structure 24 is rotated approximately 180° with wheels 40 placed at an appropriate height above top of the hull 31 (FIG. 9). The boat is inverted, set on the rotated wheel structure and secured in position using the same securing means as for the upright embodiment. The transport aspects of the invention function equally well in the inverted position and in the upright position A standard height can easily be restored in the upright position by using a locking sleeve (not shown) that travels in the upright slot to allow variable height for maintenance while locking at a precise position for normal (upright) boat use. Shown in FIG. 8 is an embodiment wherein a variable position cradle 90 mounts on the uprights 32, 33 and captures the upper edge 31 of the boat 25. The cradle 90 facilitates maintenance on an inverted boat by offering added stability. The cradle could easily be used with single or multiple sets of axles 94.

Cradle 90 can also be used with the boat 25 in the normal upright position. With the upper rail 31 of the boat 25 resting on the cradle 90, the cradle is either clamped or permanently affixed (bolted, welded, etc.) to the boat 25 with provisions for pivoting and translation of the uprights 32, 33. This embodiment allows normal functioning of the uprights without the necessity o the longitudinal adjusting means of the preferred embodiment (side rails 45, 46). The storage function of the side rails 45, 46 is integrated into the cradles by means of a stop or locking pin.

The invention can have a plurality of wheels 40 and/or axles 94. A single axle 94 can be used anywhere along the boat 25. Another axle 94 can, for example, be mounted toward the front 22 of the boat to allow mobility on four wheels, thus avoiding any need for lifting or balancing of the boat 25. One or both axles 94 can be equipped with casters (not shown) to allow even more complete mobility. Multiple axles 94 facilitate boat maintenance by keeping the boat 25 stable at a convenient working height while allowing easy maneuvering.

The semi-permanently attached wheel structure 24 acts as speed or drift control facilitating trolling, anchored or drag-anchor boat operation, or for emergency conditions. The control is effected by lowering the apparatus 24 from its storage position (position D) to create more fluid drag. The drag increases as the assembly 24 is increasingly lowered into full contact with the water 47 (toward position C). During a boating emergency (e.g., no power, operator disoriented, boat adrift, etc.) the wheel assembly 24 can be fully lowered (to either position A or B). In this position, the assembly may snag an under water object (not shown) or can run aground, thus stopping the boat 25.

Load carrying capability of the wheel structure 24 is enhanced by the horizontal connecting member 42 to upright 32, 33 joint 87 (FIGS. 5*a*, 5*b*, 5*c*, 10–14). The joint 87 is very stiff and load transfers to the boat 25 through the uprights 32, 33 as the horizontal connecting member 42 deflects under load. Hull reaction forces 95 thereby limit the horizontal connecting member's 42 deflection and enhance the load carrying capability of the invention. The capability to tolerate large hull reaction forces 95 is not uncommon because boat hulls are well known in the art that are heavily reinforced in both longitudinal and lateral directions to make them seaworthy in a relatively lightweight package. The longitudinal stiffening is achieved by deeply embossed ribs 20 along the hull; the lateral reinforcing is accomplished by uniformly placed beams (not shown) in addition to the seats (not shown) which are, in reality, very deep stiff beams.

Upright/hull interaction force 95 increases as the boat is loaded. According to the invention, uprights 32, 33 can automatically lock against the upper rail 31 with increased load which thereby fixes the axle position 94. No operator input, other than loading of the boat 25 is needed to permit automatic locking. Once the boat 25 is launched, the locking process automatically reverses as the buoyancy of the water 47 effectively unloads the assembly 24 which thereby unlocks the uprights 32, 33. Once the upright members 32, 33 are unloaded and unlocked, an operator may easily move them to the storage position (position D).

Figure 15:
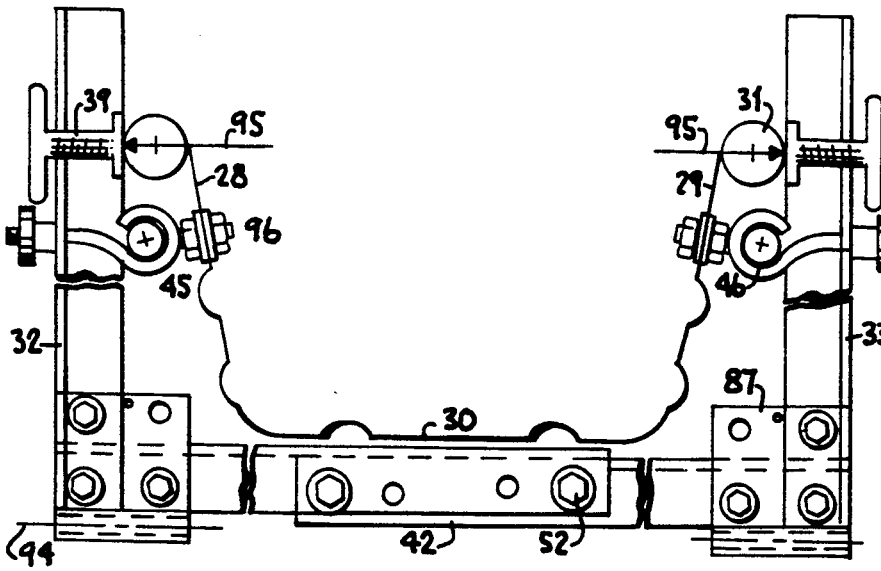
FIG. 15 is a rear elevation view of the wheel mount apparatus as installed on a boat, shown in cross section, and further showing a means for securing the apparatus in position.
Figure 16:
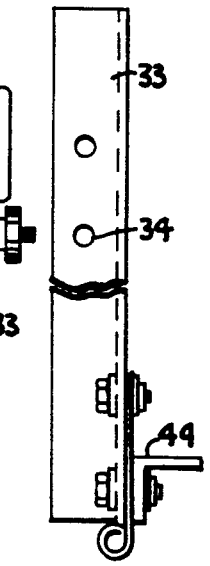
FIG. 16 is a side elevation view corresponding to FIG. 15.

The uprights 32, 33 can even pre-load the horizontal connecting member 42 by means of a securing means. For example, position locking clamps 39 (FIG. 15) can press against the boat hull. Transfer of this load to the horizontal connecting member mandates the use of stiff uprights 32, 33 and rigid horizontal connecting member to upright joints 87 or the load carrying capability can be lost as the wheel structure deforms. The clamps 39 can include either threaded or spring pre-loading, or fluidic, etc. or a combination thereof.

Figure 17:
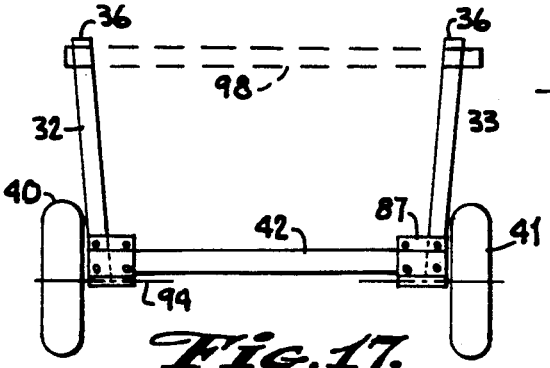
FIG. 17 is a front elevation view showing a secondary horizontal link.
Figure 19:
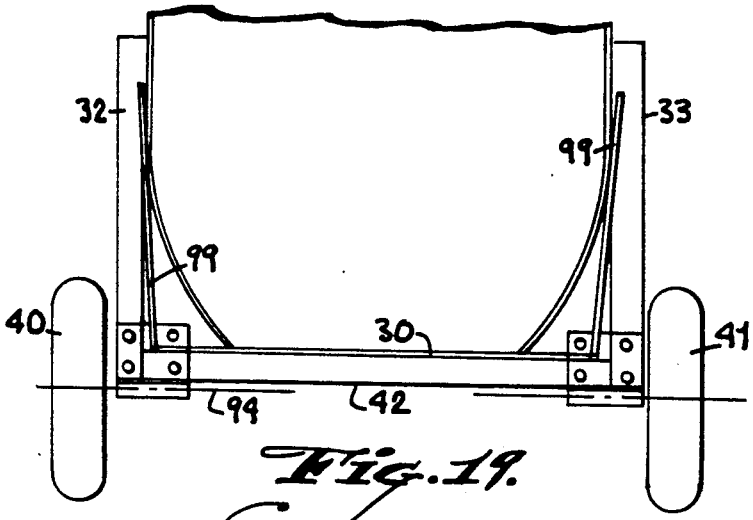
FIG. 19 is a top plan view showing tapered side rails.

Pre-loading may also be achieved by setting up the side rails 45, 46 in a ramp fashion (99 FIG. 19). Thus, as the uprights 32, 33 slide forward on the rail they are forced apart relative to each other which acts to preload the horizontal connecting member. The uprights 32, 33 can also be arranged in a splayed fashion relative to each other (FIG. 17). The splayed uprights change the loading of the horizontal connecting member 42 as the boat 25 is loaded and nests deeper into the uprights 32, 33. It is assumed that the boat 25 rests sufficiently above the horizontal connecting member 42 to prevent premature "bottoming" prior to achieving full load. Slots 53 (FIG. 7) in the uprights 32, 33 allow for the necessary vertical translation of the boat 25 relative to the uprights 32, 33 as the load 62 changes. It should be noted that in this and other embodiments, the member 42 can be of various cross sectional and longitudinal geometries.

Hull integration can be further enhanced by an operator positioned and adjustable horizontal link 98 (FIG. 17). The link is positioned between the upper ends 36 of the uprights 32, 33 pre-loading the horizontal connecting member 42 for high load carrying capability with minimal member 42 deflection. This, in turn, results in the benefits of maximum ground clearance due to minimum axle 94 deflection which thereby allows the use a horizontal connecting member 42 of shallower depth than would normally be required. The link's 98 structure can include numerous geometric configurations (e.g., tubular, rectangular, flat, etc.) and can include functional features (e.g., folding, collapsing, or pivoting for storage along one or both of the uprights 32, 33).

Minimizing the horizontal connecting member's 42 deflection through hull integration is also important to ensure proper wheel 40 geometry regardless of boat load 62. The wheel 40 camber change with load 62 increase is minimized. A fully loaded boat can therefore track properly over rough terrain.

Wheel structure 24 can easily be configured to automatically vary axle 94 position responsive to any load 62 ranging from empty to fully loaded. The axle is automatically positioned to keep the fore 22 of the boat balanced relative to the aft 23 at all times to minimize operator strain. For the reasons discussed, supra, it is assumed that the aft section 23 of the boat weighs more than the front by design. The boat 25 is supported above the horizontal connecting member (42—not shown in these figures) by a resiliently deformable member 60, for example a spring, pre-loaded plate or arm, etc. (FIGS. 20, 21) mounted on the assembly 24, the hull, etc. The member 60 could, for example, also be collapsible or retractible into the hull. As boat weight increases up to a maximum transport weight, the axle 94 position changes. The axle position moves rearward due to the changing arc of the resiliently deformable member 60 as it is loaded. This change (shown in FIG. 21) allows the axle position to change in response to the shift in the center of gravity 50 for proper balance. Load 62 symbolically represents the motor, fuel, fishing gear and any other cargo that would load the boat 25 to its full transport weight. When load 62 is removed, the boat 25 is elevated with a corresponding forward movement of the axle 94 to its pre-load position (FIG. 20) to restore balance. It should be understood that other linkages, levers, arms, etc. can be employed to optimize the positioning for specific boats and loads.

Figure 22:
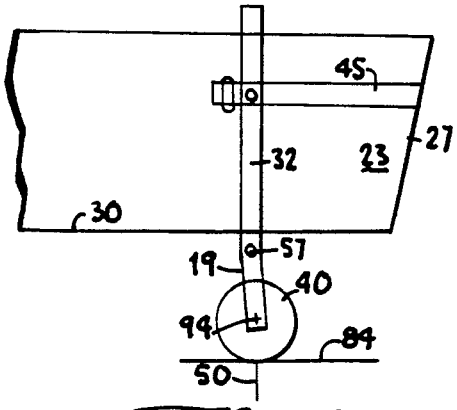
FIG. 22 is a side elevation view of the invention as attached to an unloaded boat in the operating position, showing a second embodiment of the automatic adjusting means.
Figure 23:
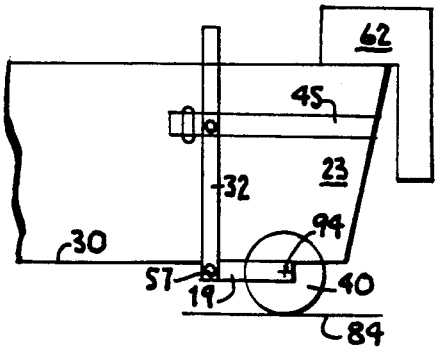
FIG. 23 is a side elevation view of the invention as depicted in FIG. 22 as attached to a loaded boat.

A wheel 40 is affixed to the horizontal connecting member 42 (not shown these figures for clarity but located approximately at torsionally sprung joint 57) by means of a spring loaded arm 19 (FIGS. 22, 23). The arm 19 deflects (or pivots) in response to load 62 changes. These load changes provide a balancing moment with a corresponding axle 94 set back to negate the unbalance due to the added weight. The ground clearance decreases as additional weight is added since the arm 19 deflection proportionately increases. Suspension stops (not shown) can ensure adequate clearance for the fully loaded condition (shown in FIG. 23). Dampers (not shown) can stabilize the system and reduce its sensitivity to bumps, etc. This design does not require upright 32, 33 movement as the load is changed.

Load 62 application anywhere in the boat 25 is accounted for by simply allowing for both forward and rearward arm 19 rotation in response to load changes with, for example, two sets of springs that each function solely on respective rotational direction from the null position. The springs (torsional, etc.) 57 function for the net loaded side without input from the other side. The axle 94 is set at the longitudinal center of gravity 50 for the unloaded condition (FIG. 22). As load is added, the arm 19 pivots accordingly.

Figure 24:
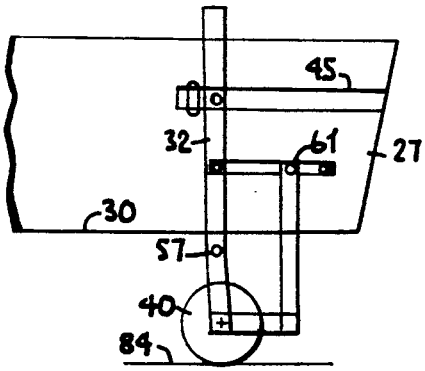
FIG. 24 is a side elevation view of the invention as attached to an unloaded boat in the operating position, showing a third embodiment of the automatic adjusting means.
Figure 25:
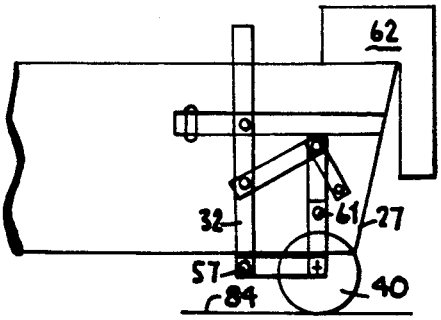
FIG. 25 is a side elevation view of the invention as depicted in FIG. 24 as attached to a loaded boat.

A simple mechanical means such as a linkage system 61 may be incorporated (FIGS. 24, 25) to translate the uprights 32, 33 to increase the wheel axle 94 offset due to increase in load 62. As the wheel axle 94 moves in response to a load 62 change, a connected link 61 interacts with the hull/upright links to effectively reduce the distance between them to translate the uprights 32, 33 and horizontal connecting member 42 relative to the hull. The friction between the boat 25 and horizontal connecting member 42 can be reduced (e.g., by rollers, bearings, teflon coating, etc.) to improve the ease of operation. The linkage system 61 may be applied to virtually all of the variable axle position embodiments. Much more complex linkages can be envisioned.

Figure 26:
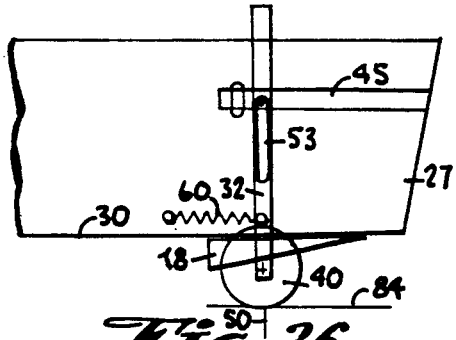
FIG. 26 is a side elevation view of the invention as attached to an unloaded boat in the operating position, showing a fourth embodiment of the automatic adjusting means.
Figure 27:
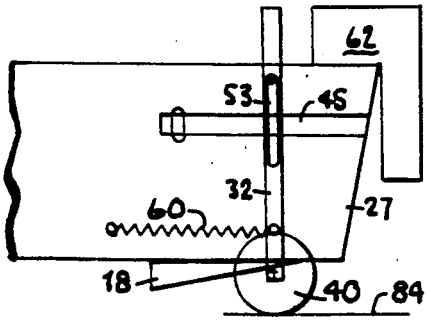
FIG. 27 is a side elevation view of the invention as depicted in FIG. 26 as attached to a loaded boat.
Figure 28:
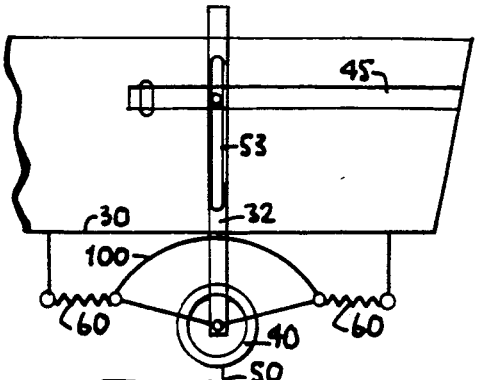
FIG. 28 is a side elevation view of the invention as attached to an unloaded boat in the operating position with a fifth embodiment of the automatic adjusting means shown.
Figure 29:
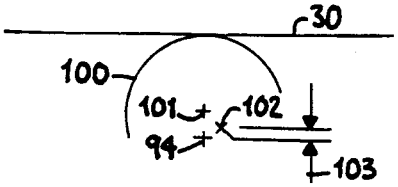
FIG. 29 is a detailed side elevation view of the invention depicting the area around the automatic adjusting means of FIG. 28.
Figure 30:
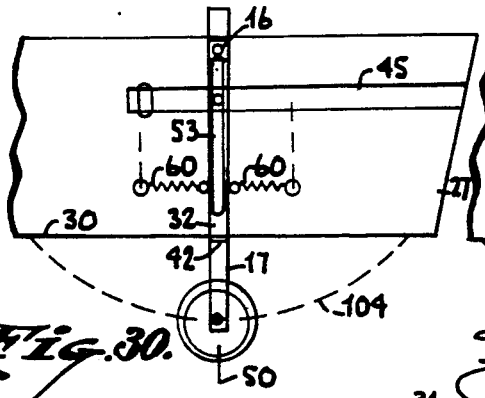
FIG. 30 is a side elevation view of the invention as attached to a boat in the operating position with a sixth embodiment of the automatic adjusting means shown.
Figure 31:
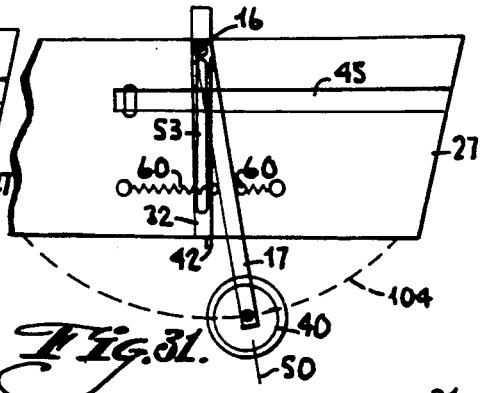
FIG. 31 is a side elevation view of the invention as depicted in FIG. 30 as attached to a boat with load.

In contrast to the auto axle positioning embodiments described above, the systems described below do not spring suspend the boat but balance the axle 94 in an meta-stable position using springs 60 (FIG. 26–32). The axle 94 is located at the longitudinal center of gravity 50 of unloaded boat 25 (FIGS. 26, 28 and 30). As load 62 is added, the boat 25 achieves a new stable position by slightly decreasing the boat elevation as the wheel assembly translates.

A non-suspension method of axle re-positioning is shown in FIGS. 26 and 27. Ramp 18 and a spring 60 position the axle 94 to account for load 62 changes mainly in the aft section 23 of the boat. The initial axle position (FIG. 26) is chosen such that the boat 25 will be balanced for the unloaded case. The spring 60 rate, pre-load, and ramp 18 details are chosen to negate some or all of the unbalance resulting from additional weight that is added. Balance also restores as weight is removed (from the aft section 23). The positioning ramps 18 are shown on the bottom of the boat for explanatory purposes. The ramps can be collapsible or retractable into the bottom of the hull or placed on the side of the hull 28, 29 or combined, for example, into the side rails 45, 46 with the same functionality. The uprights 32, 33 provide for both horizontal movement along the side rails 45, 46 and vertical movement in the channel 53 as the axle 94 translates along the ramp 18 during an auto position event. The ramps 18 can include a low friction surface or employ rollers, etc. (not shown) to enhance the operation.

The ramps 18 are easily configured to account for load changes in the fore as well as the aft compartments of the boat. A fore ramp and spring system (not shown) can be a mirror image of the aft set. To balance the boat in the "unloaded" case, the fore and aft spring forces are balanced to result in no net movement. As load is added, the axle translates either fore or aft depending on the location of load application; if the load applies at the longitudinal center of gravity 50, there is no net axle translation.

Referring now to FIGS. 28 and 29. Load 62 can be applied anywhere on the boat 25 with a minimum change in boat elevation. The wheel 40 is rotatably fixed directly to the uprights 32, 33. The uprights 32, 33 pivot about the curvilinear surface 100 and use springs 60 to balance the fore 22 and aft 23 moments. The wheel axle 94 is connected to a curvilinear surface 100. This surface interacts with the underside 30 of the boat 25 by friction or, for example, by means of a geared rack and pinion (not shown). As seen in FIG. 28, the system spring balances in meta-stable equilibrium with the axle 94 at the longitudinal center of gravity 50 for an unloaded boat. As a load is applied, the curvilinear system rotates to move the axle 94 toward the loaded side and to move the boat *away* from the loaded side. This effectively minimizes the unbalanced moment due to the added weight. The motion of the boat 25 relative to the axle 94 can be used to optimize the design. In the alternative, a frictionless interface can be used by incorporating, for example, rollers (not shown) at the interface of the curvilinear surface 100 and the hull thereby eliminating the relative boat motion.

The wheel axle 94 is located below the centerline 101 of the curvilinear surface 100 with the system at rest (FIG. 29). A new axle position 102 results in offset 103 as a load 62 is applied. The offset 103 creates a net lowering of the boat to a more stable position (more nearly in equilibrium). As load is removed, the springs 60 take over to restore the system to a new quasi-equilibrium position.

A somewhat simpler embodiment than that shown in FIGS. 28 and 29 is presented in FIGS. 30, 31, 32 and 33. Wheels 40 are affixed to the uprights 32, 33 by means of a pivotable link 17. The pivotable link 17 allows the wheels 40 to change positions in response to load. The boat 25 rests on the horizontal connecting member 42. Springs 60 effect a balance of the wheels in a quasi-equilibrium position at the longitudinal center of gravity 50 of the unloaded boat. As load is added (FIG. 31), a new equilibrium position of the axle is established resulting in a slight lowering of the boat 25. The springs 60 may be mounted most anywhere (e.g., on the hull, the side rails 45, 46, the upper rails 31, etc.). Alternatively, the springs can be torsionally configured between the link 17 and the uprights, the hull, the side rails, etc.

Figure 32:
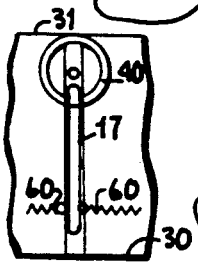
FIG. 32 is a side elevation view of the invention as depicted in FIG. 30 with the invention in an optional storage position with wheel storage at the top of the uprights.
Figure 33:
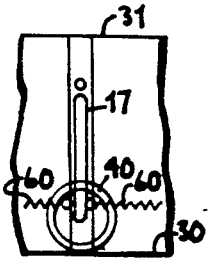
FIG. 33 is a side elevation view of the invention as depicted in FIG. 30 with the invention in a second optional storage position with wheel storage at the bottom of the uprights.

The link 17 can be made in a multitude of shapes and can be affixed to the uprights 32, 33 using many means. For example, the link 17 is sufficiently long to extend beyond the link pivot point 16. In this embodiment, the traditional uprights 32, 33 and horizontal connecting member 42 are permanently affixed to the hull (or built into it) with the links 17 and wheels 40 stored along the uprights as shown in FIGS. 32 and 33. The link 17 can telescope (FIG. 33) into or along the appropriate upright 32, 33. The link 17 can also rotate to an "upright" position (approximately 180 degrees of rotation) and slide along the upright 32, 33 for storage (FIG. 32). The link 17 can be configured in at least two pieces hinged together (not shown) so that it could fold back upon itself for easy storage along the hull adjacent to the "normal" upright 32, 33. The link 17, uprights 32, 33 and member 42 could be arranged to store at position D. However, if permanently affixed, the assembly (member 42, uprights 32, 33) offers minimum water drag by being of shallow cross section (42) and/or having a multiplicity of holes to allow the free passage of water.

Figure 20:
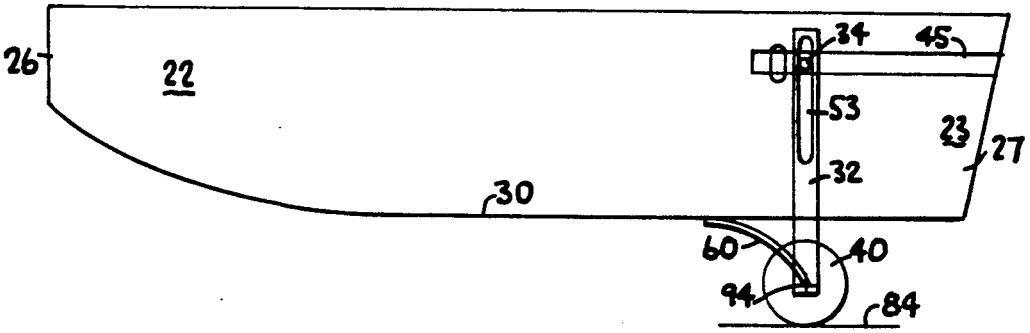
FIG. 20 is a side elevation view with the mounting apparatus attached to an unloaded boat in the operating position, with an embodiment of the automatic adjusting means shown.
Figure 21:
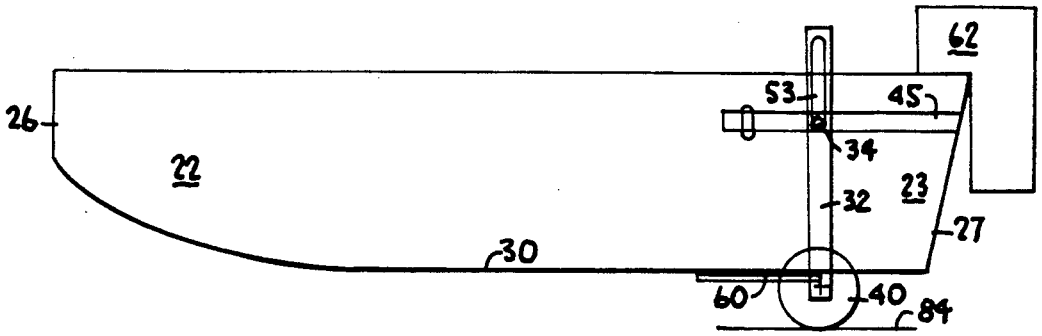
FIG. 21 is a side elevation view of the invention, corresponding to FIG. 20 and attached to a loaded boat.

The wheel assembly 24 with the auto position adjust features of FIGS. 20 though 31 are moved into operating position (position A) using the same method as before. When the boat 25 is removed from the water 47, the weight of the boat will automatically position the wheel structure 24 for appropriate balance. The process automatically reverses when the boat 25 is rolled back into the water 47 as the buoyancy unloads the wheel structure thereby allowing it to be easily retracted.

Figure 34:
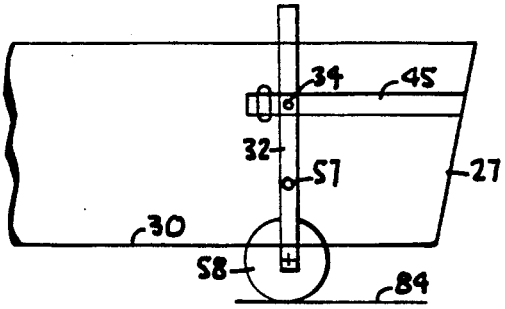
FIG. 34 is a side elevation view of the invention showing a ganged wheel embodiment as attached to a boat in the operating position with the ganged wheels operating along the same axle shaft axis.
Figure 35:
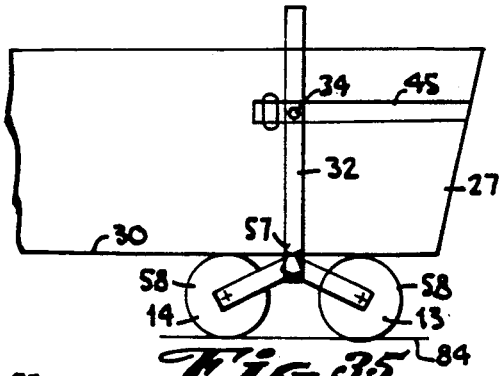
FIG. 35 is a side elevation view of the invention as depicted in FIG. 35 as attached to a boat with the ganged wheels separated for greater stability.
Figure 36:
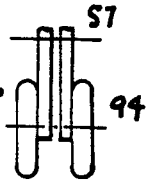
FIG. 36 is a detail front elevation view showing the ganged wheels of the embodiment of the invention depicted in FIG. 34.

Multi-functional ganged dual wheels 58 may replace the standard wheel 40 on each side to allow for improved all terrain use (FIGS. 34–36). They include a fore wheel 14 and aft wheel 13 and respectively allow for approximately 90° of movement when loaded from the null position (FIG. 34). The wheels 58 are sprung relative to each other at 57 such that the spring load forces them together while the boat is unloaded. For storage, the wheels are then retracted by hand (or, for example, automatically by another spring—not shown) longitudinally along or, in the alternative, telescoped into the appropriate upright 32, 33 with final assembly storage at position D. When the wheel structure 24 is deployed to the operating position (position A) the wheels 58 can be used, at the operator's discretion, in either the retracted side by side mode (FIG. 34) or in the tandem splayed mode (FIG. 35) when pulled down from the uprights. The retracted side by side mode results in lower ground unit loading in soft terrains. The tandem splayed mode adapts for rough terrain use to maneuver over obstacles with superior stability and balance with minimal operator input.

When launched into the water, the wheels 58 will automatically unload and pivot together when buoyancy takes over. The retraction process to the storage position (position D) is identical to the basic embodiment. When retracted and stored, this embodiment will store out of the way in a minimum amount of space occupying only slightly more space than the standard, basic embodiment. This embodiment can be used with any of the auto position embodiments described above.

The effort to move a loaded boat will be dramatically reduced over all terrain by the invention. On sloping terrain, speed control is provided for the operator's protection as well as that of the boat 25. Automatic braking 64 is accomplished simply by a pivotally mounted pendulum affair 12 attached to the upright 32, 33. The pendulum attachment can alternatively be to the hull or the horizontal connecting member 42. The pendulum attachment is automatically operated as a function of boat 25 attitude. The braking takes place either directly on the wheel 40 or on an affixed drum, disc, etc. (not shown).

Figure 37:
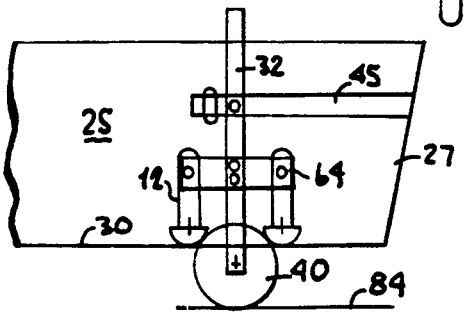
FIG. 37 is a side elevation view of the invention as attached to a boat in the operating position with one embodiment of the automatic braking means shown disengaged.
Figure 38:
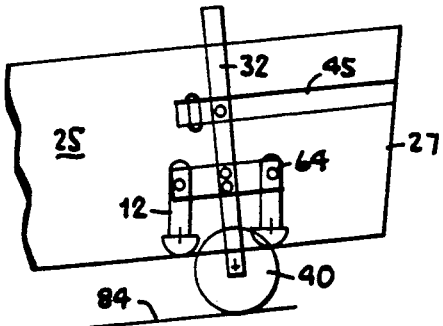
FIG. 38 is a side elevation view of the invention as depicted in FIG. 37 with the automatic braking means shown engaged.

Operator input is not required since the slope of the ground 84 will automatically initiate the braking action. The operator, however, can assist or reduce the onset and/or the degree of braking by either raising or lowering the nose 26 of the boat. A set of fore and aft brakes for each wheel 40 ensure the braking system is functional regardless of wheel rotational direction. The braking action is self-energizing. A small amount of force is translated in to a large braking effect by the rotational direction of the wheel and angle of the pendulum 12. FIGS. 37 and 38 depict the automatic braking system both at rest (FIG. 37) and in action on a slope (FIG. 38). The operator (not shown) can allow the brakes to lockup to ensure complete safety and bring the boat 25 to a halt. To release the brake, all that is required is that the operator push in the opposite direction thereby causing wheel movement to push the brake out of the lock position.

The aggressiveness of the pendulum system 12 is modulated by design and/or positioning changes of the elements. For example, the complete system could be raised or lowered with the pendulum element length modified to change the angle of incidence of the elements relative to the wheel at the onset of braking to change the degree of braking in terms of the "self-energizing" impact. The individual braking elements can be changed by adding mass and/or by changing the element length to enhance the leverage for added braking effort.

A spring pre-loaded pendulum brake element functions automatically to trip and apply brakes above a threshold based on wheel speed measured directly or deduced indirectly through vertical amplitude resulting from a combination of speed and terrain roughness. This system functions without operator input although operator input can trigger the system by, for instance, raising or lowering the nose 26 of the boat 25.

Figure 39:
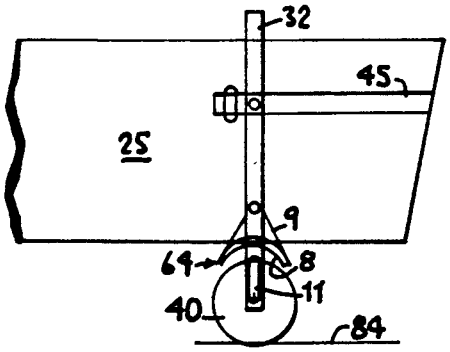
FIG. 39 is a side elevation view of the invention as attached to an unloaded boat in the operating position with a second embodiment of the automatic braking means shown.
Figure 40:
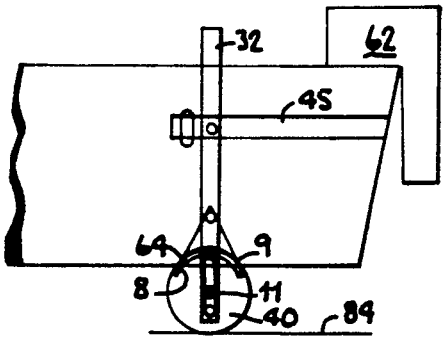
FIG. 40 is a side elevation view of the invention as depicted in FIG. 39 as attached to a loaded boat with the automatic braking means shown engaged.
Figure 41:
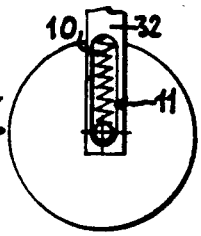
FIG. 41 is a detail side elevation view of the invention as depicted in FIG. 39 showing the vicinity of the wheel.

A braking system 64 combined with an active suspension system is shown in FIGS. 39, 40 and 41. A coil spring 10 affixed to either the upright 32, 33 or the horizontal connecting member 42 (not shown in these figures) suspends the wheel 40, cushioning bumps under normal surface conditions. The upright arms 32, 33 are stationary with regard to the boat 25. The wheel 40 is allowed to translate vertically relative to the upright 32, 33 in response to load 62 and/or ground 84 conditions. The integrity of the uprights 32, 33 to the horizontal connecting member 42 is still maintained as previously described with all of its inherent benefits. At low speeds, with a given terrain, wheel displacements are small. For higher speeds, under these same surface conditions, the wheel displacements will be much higher.

When these characteristics are used in conjunction with a stationary-mounted brake shoe 9, the braking is effected only at the higher rates of speed where it is most needed to maintain control. At low speeds, there is no wheel contact with the brake shoe 9 while, at higher speeds, the higher deflections provide periodic contact with the shoe 9 effectively retarding the speed. The invention automatically load compensates as the static wheel deflection increases as the load 62 increases. The clearance between the shoe 9 and the wheel 40 thereby decreases, increasing the potential amount of time that the brake is "on" during use. This embodiment functions over all terrains on all slopes with all boat loads. The brake shoe 9 can be as simple as a semi-circular affair with friction material 8 on the face adjacent to the outer wheel surface (FIGS. 39, 40). The brake shoe mounting can be either stationary or allow for pivoting and/or eccentric mounting as is necessary for a self energizing scheme.

Figure 42:
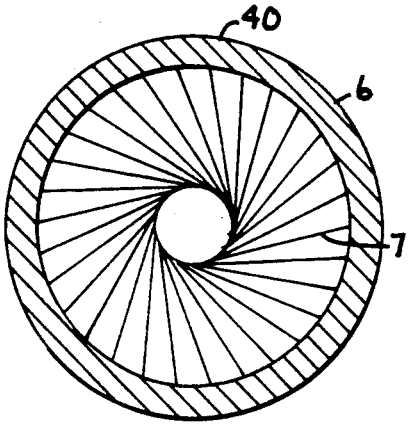
FIG. 42 is a cross sectional view of a third embodiment of the invention incorporating an automatic braking means showing centrifugally actuated braking elements.

Referring now to FIG. 42, a series of centrifugal fingers 7 (or shoes, etc.) is affixed to the wheels 40 such that as the speed increased above a certain point, the fingers extend toward and contact a stationary surface or drum 6 to effect a retarding action. This embodiment is inherently self regulating as the fingers 7 retract as the speed decreased below the trip point and re-engage as the speed moved above the trip point. The trip point can be load compensated since the finger pre-load can be a function of load.

Figure 43:
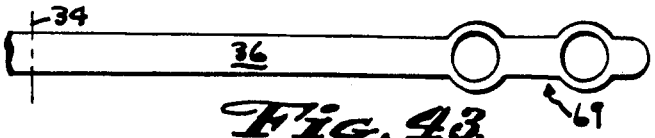
FIG. 43 is a top plan view of the upper portion of the upright member of the invention incorporating fishing pole holders.

The uprights 32, 33 are multi-functional. The upper portion 36 includes an enlarged pocket or hole 69 capable of supporting a fishing pole (not shown). Fishermen would use the support (FIG. 43), for example, during trolling operations where the operator can not give full attention to the pole as he is concentrating on controlling the boat.

Figure 44:
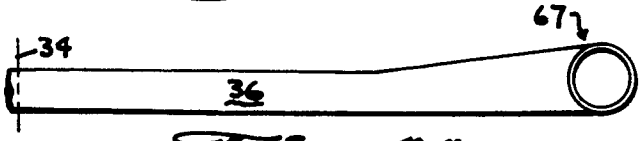
FIG. 44 is a top plan view of the upper portion of the upright member of the invention incorporating a beverage container holder.

The uppermost end of the arms 36 can include a recess 67 to allow the containment of a beverage cup or glass (FIG. 44). The recess 67 can include local water to cool a drink. Alternatively, recess 67 can include thermal insulation for maintaining beverage temperature. In any form, the recess 67 functions principally when the uprights are stored (position D) such as when the boat is on the water. The uppermost end of the arms 36 can also be arranged to pivot to maintain an upright attitude for a beverage. The recess 67 thus holds beverage containers both with the uprights 32, 33 in an operating position (position A—e.g., wheels 40 lowered for added drag) and in the storage position.

Figure 45:
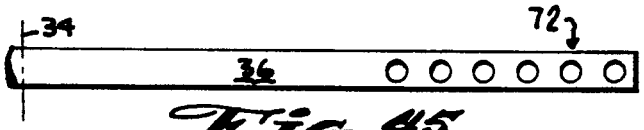
FIG. 45 is a top plan view of the upper portion of the upright member of the invention incorporating variable position oar pivots.
Figure 46A:
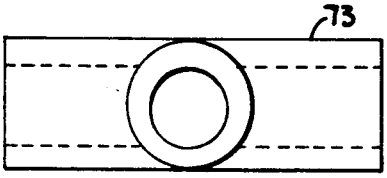
FIG. 46a is a top plan view of an adjustable oar lock.
Figure 46B:
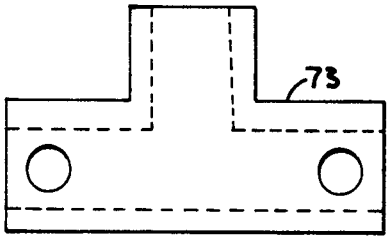
FIG. 46b is a side elevation view of an adjustable oar lock.
Figure 46C:
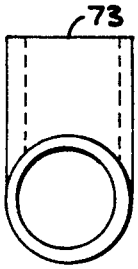
FIG. 46c is a front elevation view of an adjustable oar lock.
Figure 47:
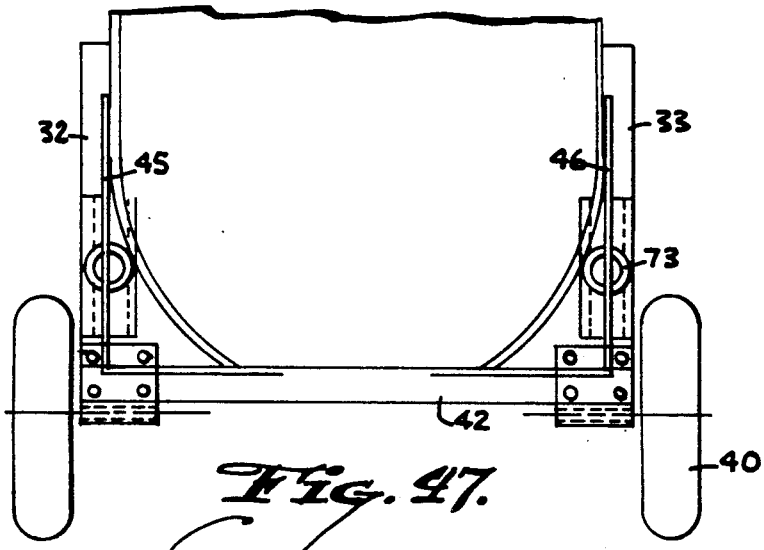
FIG. 47 is a top plan view of the invention in a storage position and incorporating the adjustable oar lock of FIGS. 46a, 46b and 46c.
Figure 48:
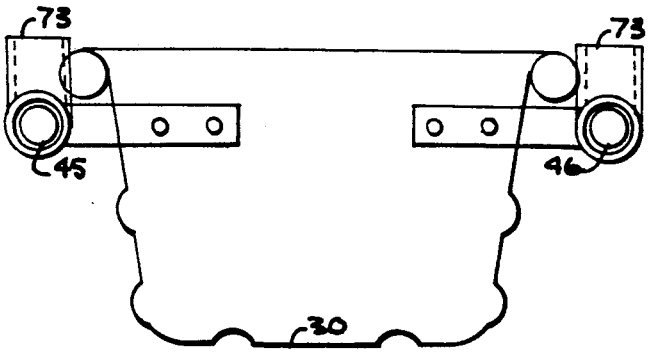
FIG. 48 is a cross sectional view taken along line g—g of the invention as depicted in FIG. 47 with the wheels and upright members not shown.
Figure 49:
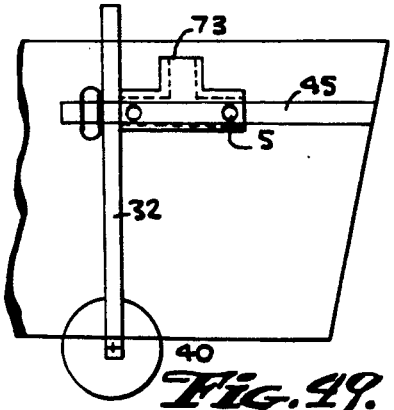
FIG. 49 is a side elevation view of the invention in an operating position and incorporating the adjustable oar lock of FIGS. 46a, 46b and 46c.

The upper portion 36 of uprights 32, 33 can also include a multiplicity of holes 72 along their length (FIG. 45) accommodating variable position oar pivots (not shown). The holes 72 optimize oar position relative to a specific user/seat combination maximizing the operator's mechanical efficiency.

Variable oar positioning is also accomplished using the side rails 45, 46 (FIGS. 46*a*, 46*b*, 46*c*, 47, 48 and 49). Infinitely positionable oar pivots 73 mount to side rails 45, 46 such that they freely translate along the rails 45, 46 and lock in any desired position by tightening adjusting screws 5, etc. When the oars (not shown) are not in use, the pivot 73 can function to lock (FIG. 49) or fix the position of the uprights 32, 33.

Figure 50:
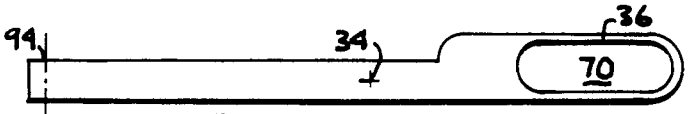
FIG. 50 is a top plan view of the upper portion of the upright member of the invention incorporating ballasted hand grips.
Figure 51:
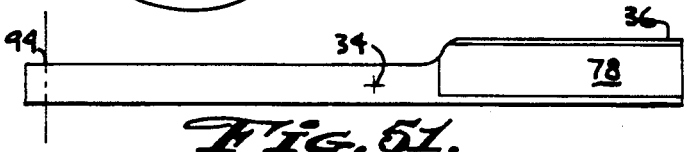
FIG. 51 is a top plan view of the upper portion of the upright member of the invention incorporating light/-flare holders.
Figure 52:
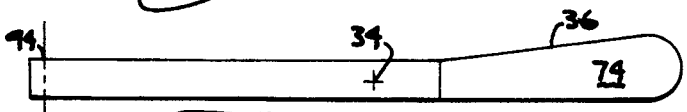
FIG. 52 is a top plan view of the upper portion of the upright member of the invention incorporating a liquid storage tank.

The upper portions 36 of the uprights 32, 33 can include mass 70 to counter balance the weight of the wheels 40 (FIG. 50) thus reducing the effort required for raising or lowering the uprights. The mass 70 can be multi-functional and, for example, may include an auxiliary sealed tank (FIG. 52). The tank can store fuel, drinking water, or simply ballast. For an added degree of safety, the upper portion 36 of the upright members 32, 33 can function as a light holder 78 (FIG. 51) whereby running lights, fog lights, warning lights or safety flares (not shown) are used with the uprights 32, 33. The uprights 32, 33 function additionally as hand grips with pockets (FIG. 50) capturing the hands for ease of operation and increasing leverage thus minimizing the effort required in operating the assembly 24.

Combination of the features discussed above increases the functionality of the assembly 24. For example, in emergency conditions the wheel assembly 24 can be fully lowered (position A) into the water 47. Drag thus increases thereby slowing the drift of the boat 25. The light holder ends 78 can assist the operator in summoning help and/or marking boat position thus helping search teams with rescue efforts.

Figure 4:
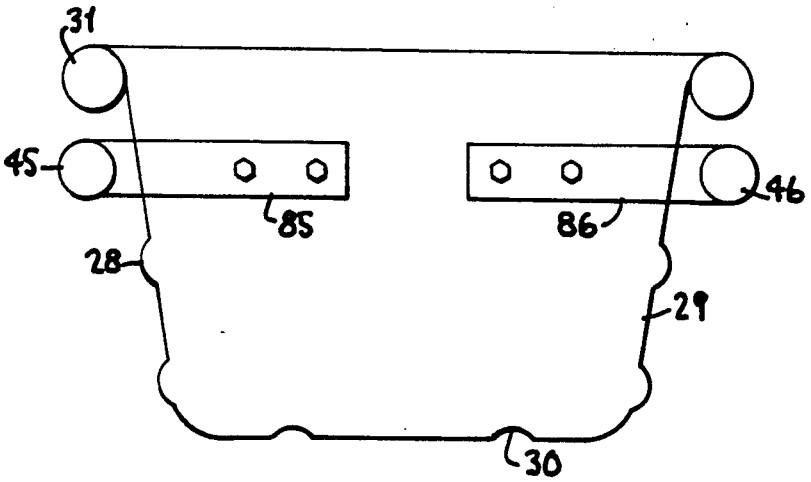
FIG. 4 is a rear elevation view showing the longitudinal adjusting means and its attachment to the boat, shown in cross section.
Figure 5A:
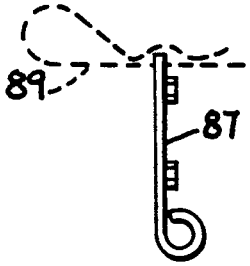
FIG. 5*a* is an side elevation view of a wheel mounting bracket in locked configuration.
Figure 5B:
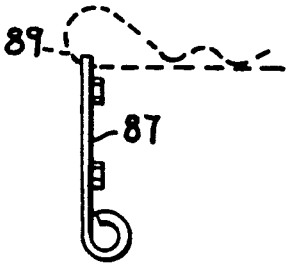
FIG. 5*b* is an side elevation view of a wheel mounting bracket in unlocked configuration.
Figure 5C:
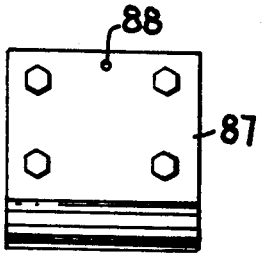
FIG. 5c is an front elevation view of a wheel mounting bracket.
Figure 13:
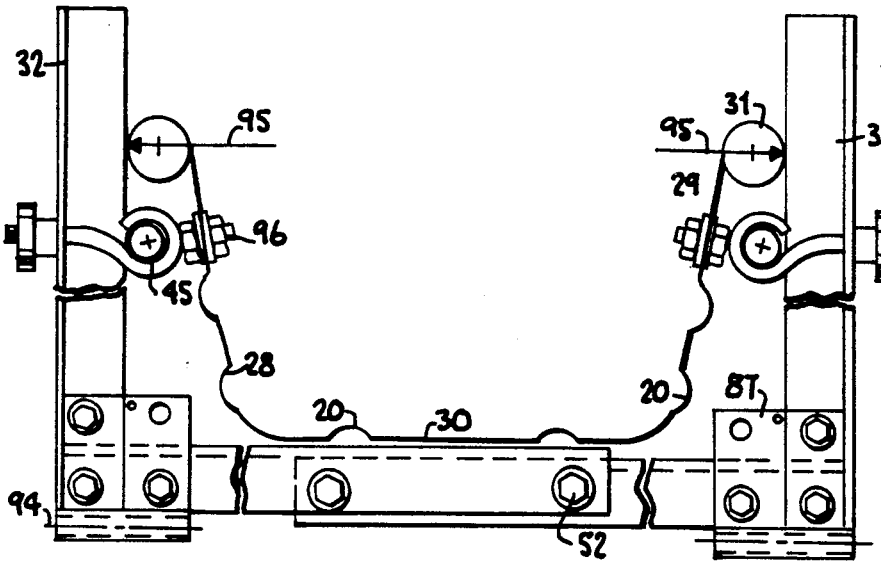
FIG. 13 is a rear elevation view showing the longitudinal adjusting means, the boat being shown in cross section.
Figure 14:
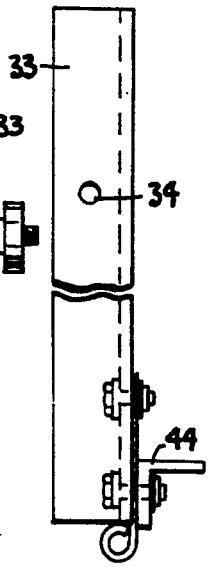
FIG. 14 is a side elevation view of the invention as depicted in FIG. 13.

The side rails 45, 46 serve primarily to guide, locate and position the assembly 24 (FIG. 4, 13 and 14). The side rails 45, 46 also automatically maintain an orthogonal position of the horizontal connecting member 42 relative to the length of the boat 25 for all axle 94 positions. This ensures true tracking of the wheels for all terrains. The side rails 45, 46 function secondarily to facilitate storage in the retracted position (position D). Axle brackets 87 nest adjacent to the rails 45, 46 such that quick release pins 89 (FIGS. 5*a*, 5*b* and 5*c*) interlock with the rails (near the transom). The interlocking prevents rearward motion of the assembly 24 while in a storage position.

The upper rail 31 of the boat 25 can integrate the functions of the side rails 45, 46. This integration eliminates the need for the side rails. If the side rails 45, 46 are used, however, their length and vertical location are limited only by the requirement that they allow axle 94 positioning for boat 25 balance. Side rails 45,446 which run the full length of the boat 25, however do allow for infinitely variable positioning as well as a set of fore and aft wheels 40.

Figure 18:
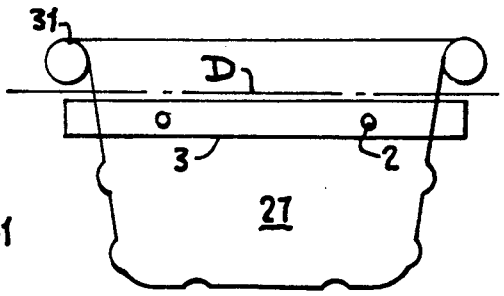
FIG. 18 is a rear elevation view of the storage ledge of the invention as attached to a boat.
Figure 53:
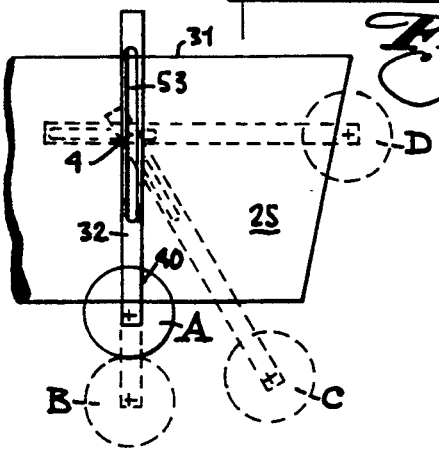
FIG. 53 is a side elevation view of an embodiment of the invention incorporating a single attachment point per side.

Pivots 4 on either side of the hull, in conjunction with upright slots 53, can allow similar functionality of the invention without the need for side rails 45, 46 (FIG. 53). There are, however, several disadvantages to this embodiment as it lacks an infinite number of axle 94 positions; this problem is easily solved by auto axle positioning and allowing the upright 32, 33 to "float" about its pivot 4 thereby allowing the axle 94 to translate for balance. A second disadvantage is that, to lock in place, the assembly must be physically lifted up to the hull when released from the storage position (position D). This disadvantage is minimized by including, for example, springs, a linkage system, etc. (not shown) thus offsetting the assembly weight. Most of the advantages of the assembly with side rails, however, still apply to this embodiment. In the storage position (position D), the axle assembly 24 still rests on the transom 27 at the ledge 3 (FIG. 18). In general, the ledge 3 may be affixed to the boat 25 either parallel or perpendicular to the transom 27 with similar results. Pin or bolt projections 2 from transom 27 may also secure the axle assembly 24 in the storage position. The projections 2 can either replace or function in tandem with ledge 3. The function of ledge 3 is easily integrated into the boat 25 design.

Figure 54:
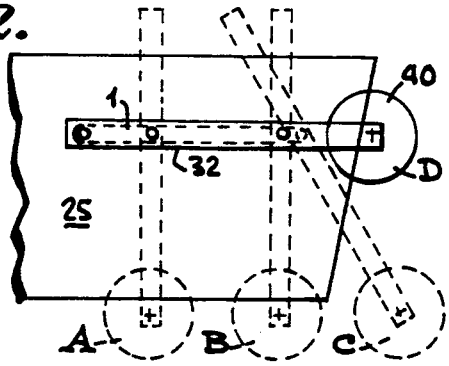
FIG. 54 is a side elevation view of an embodiment of the invention incorporating a slotted hull.
Figure 55:
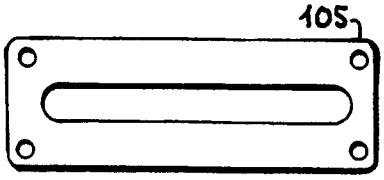
FIG. 55 is a side elevation view of bolt on slotted plate.

The side rails 45, 46 can also be replaced by horizontally disposed slots 1 in the side of the boat hull. These slots must be long enough to allow a wide range of axle 94 position adjustability (FIG. 54). The slots 1 include water proofing seals (not shown) to keep water 47 from entering the boat 25. Similarly, side rails 45, 46 can also be replaced with horizontally disposed slotted plates 105 (FIG. 55). These plates are affixed to the hull at the appropriate position allowing proper axle 94 positioning and movement without the risk to hull integrity encountered when slotting the hull.

Figure 56:
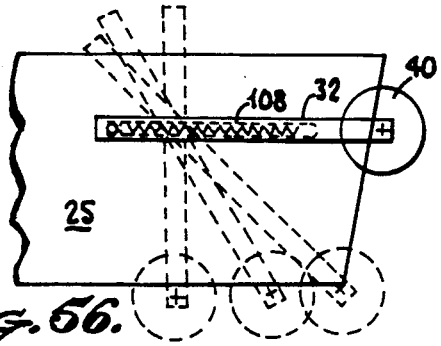
FIG. 56 is a side elevation view of the invention incorporating a spring loaded upright member.
Figure 56A:
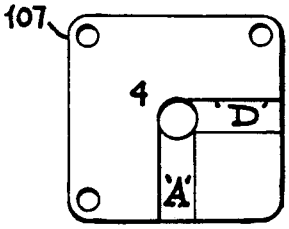
FIG. 56*a* is a detail side elevation view of an upright position plate of FIG. 56.

The uprights 32, 33 can include a spring loaded, or other means, telescoping design (FIG. 56). The uprights pivot about a single point 4 on an upright position quadrant plate 107 (FIG. 56*a*). This plate mounts in a stationary manner to the hull and incorporates, for example, two detents. Detent "A" maintains an operational position and detent "D" maintains a storage position. These detents are manually or automatically locked with, for example, springs and a pin (not shown). This embodiment incorporates the functions of the side rails 45, 46 and the rear ledge 3. This embodiment can additionally incorporate the auto axle positioning mechanisms described above with the telescoping arms 108 automatically accounting for any changes in axle position without necessarily using detent position A (FIG. 56*a*).

Figure 57:
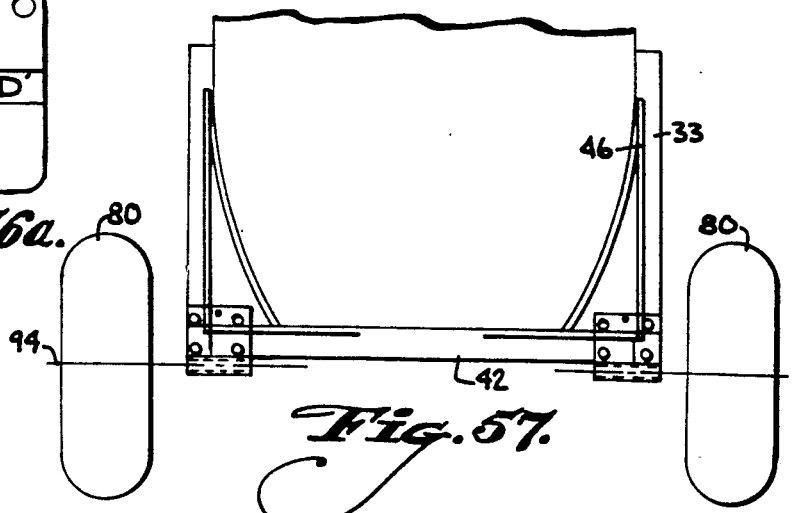
FIG. 57 is a top plan view of the invention in a storage position incorporating high floatation tires.
Figure 58:
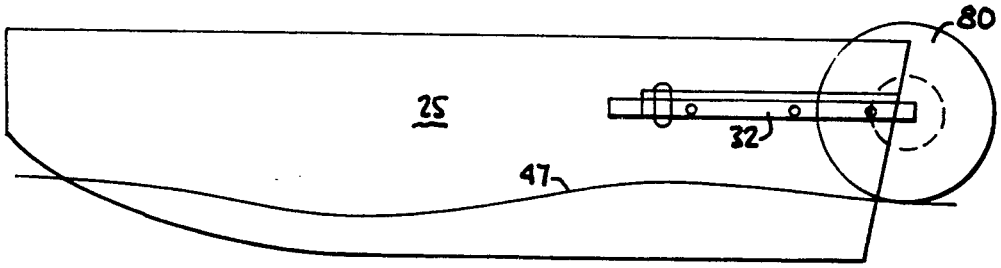
FIG. 58 is a side elevation view of the invention as depicted in FIG. 57.

Rearward placement of the wheels 40 just above the water 47, in addition to being out of the way, can enhance boat 25 operations. Large, light weight, and high floatation tires 80 are used as outriggers or pontoons to enhance boat stability (FIGS. 57 and 58). Additionally, the track width of the wheels 80 is expanded to maximize stability. These large tires 80 also act as boat dock bumpers, protecting the boat from impact damage. Large buoyant tires 80 can additionally act as emergency personal floatation devices (PFD's). In the preferred embodiment, wheels 80 are instantly removable, without tools, by means of a rapidly removed pin (not shown). Large wheels 80 also function well on soft terrain as they have very low ground pressure.

What is claimed is:

1. An auxiliary deployable boat wheel apparatus for all terrain transportation, launching, and recovery of a boat, said boat having front and rear longitudinal end portions, first and second lateral sides and a bottom, the apparatus comprising:

a first upright member and a second upright member for the respective lateral sides of the boat, each said upright member having a pivot point, each said pivot point being defined by a mounting means with the two pivot points being coaxial and defining a pivot axis along a lateral line through the boat, each said pivot point separating the respective upright member into an upper portion and a lower portion, said lower portion having a distal end for carrying a wheel, said mounting means being adjustable whereby the upright members can be set at least to one of a substantially vertical position and a substantially horizontal position;

means for securing each said upright members in at least one of said substantially vertical position and said substantially horizontal position;

a first wheel and a second wheel rotatably mounted to said distal end of said lower portion of each said upright member;

a horizontal connecting member, said horizontal connecting member being rigidly attached between the lower portions of each said upright member;

a first longitudinal adjusting means and a second longitudinal adjusting means, each said longitudinal adjusting means being rigidly secured to said boat above a water-line and extending in a forward and a rearward direction along a span preferably encompassing a longitudinal center of gravity of said boat on said lateral sides, each said longitudinal adjusting means adjustably securing said mounting means along a substantial part of its length;

whereby each said upright member is adjustable to keep each said wheel in an operating position at said center of gravity of said boat when in said substantially vertical position and is adjustable to place each said wheel in a storage position above said water-line at said rear longitudinal end of said boat.

2. The apparatus of claim 1, wherein each said upright member may be rotated approximately 180° about said pivot point from an upright operating position to an inverted operating position, said upright operating position being defined by each said wheel being at least partially disposed below said bottom of said boat;

said inverted operating position being defined by each said wheel being at least partially disposed above a top edge of said boat, whereby said boat may be transported overland and launched in an upright attitude while each said upright member is in said upright operating position and said boat may be transported in an bottom-up attitude while each said upright member is in said inverted operating position.

3. The apparatus of claim 2, further comprising height adjusting means for allowing said pivot point to be moved along a span of each said upright member, whereby a height of said boat in at least one of said inverted operating position and said upright operating position can be set by an operator.

4. The apparatus of claim 1 wherein said apparatus is completely external to said boat in both the operating position and the storage position.

5. The apparatus of claim 1 wherein said horizontal connecting member further comprises a length adjusting means, whereby the length of said horizontal connecting member is adjustable to accommodate a variety of boat widths and the uprights may be collapsed about the horizontal connecting member for compact storage when separated from said boat.

6. The apparatus of claim 1 further comprising automatic adjustment means for keeping each said wheel under said center of gravity while in said operating position.

7. The apparatus of claim 6 wherein said automatic adjustment means further comprises at least one torsionally sprung joint located in said lower portion of each said upright member.

8. The apparatus of claim 7 wherein each said wheel is replaced by at least one pair of ganged dual wheels, whereby said ganged dual wheels provide a more stable platform around said center of gravity.

9. The apparatus of claim 6 wherein said automatic adjustment means further comprises at least one resiliently deformable member and at least one mechanical means operable to convert at least one of a downward force and changes in a downward force caused by a weight of a load into a force tending to move each said wheel toward said center of gravity, whereby said at least one resiliently deformable member acts to restore each said wheel to a position beneath a new center of gravity when said load is removed.

10. The apparatus of claim 1 wherein said apparatus is adapted for hand operation, whereby said apparatus adjusts between said operating position and said storage position by hand.

11. The apparatus of claim 10 wherein said apparatus is further adapted for hand removal and hand installation, whereby said apparatus removal from said boat and installation on said boat is done by hand.

12. The apparatus of claim 1 further comprising:

at least one self actuating brake means, said self actuated brake means being actuated by at least one of an excessive speed and a boat orientation.

13. The apparatus of claim 1 wherein said upper portion of each said upright member defines at least one recess dimensioned to receive at least one beverage container while in at least one of said operating position and said storage position.

14. The apparatus of claim 1 wherein said upper portion of each said upright member defines at least one recess dimensioned to receive at least one fishing pole while in at least one of said operating position and said storage position, whereby in said operating position said apparatus minimizes a drift of said boat.

15. The apparatus of claim 1 wherein said upper portion of each said upright member further comprises at least one counterweight, whereby moving said apparatus from said operating position to said storage position is accomplished with a minimum of effort.

16. The apparatus of claim 15 wherein said at least one counterweight further comprises at least one fluid storage tank.

17. The apparatus of claim 16 wherein said at least one fluid storage tank functions as at least one of an auxiliary fuel tank, an insulated beverage container, and a beverage cooler.

18. The apparatus of claim 1 wherein said upper portion of each said upright member defines at least one recess dimensioned to receive at least one oar pivot while in at least one of said operating position and said storage position, whereby an operator can adjust said at least one oar pivot to a comfortable position.

19. The apparatus of claim 1 wherein said upper portion of each said upright member defines at least one recess dimensioned to receive at least one safety flare while in at least one of said operating position and said storage position.

20. The apparatus of claim 1 wherein each said wheel is highly buoyant, whereby each said wheel functions as at least one of pontoons and outriggers, adding stability in rough water while in at least one of said storage position and said operating position.

21. The apparatus of claim 20 further comprising:

quick release means for each said wheel, whereby each said wheel functions as a personal floatation device in an emergency.

* * * * *